United States Patent [19]

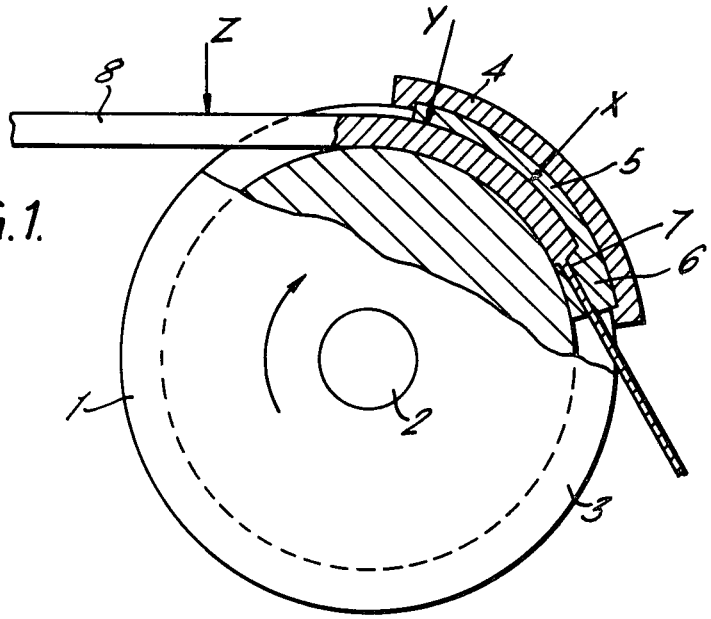
FIG.1.
FIG.2.
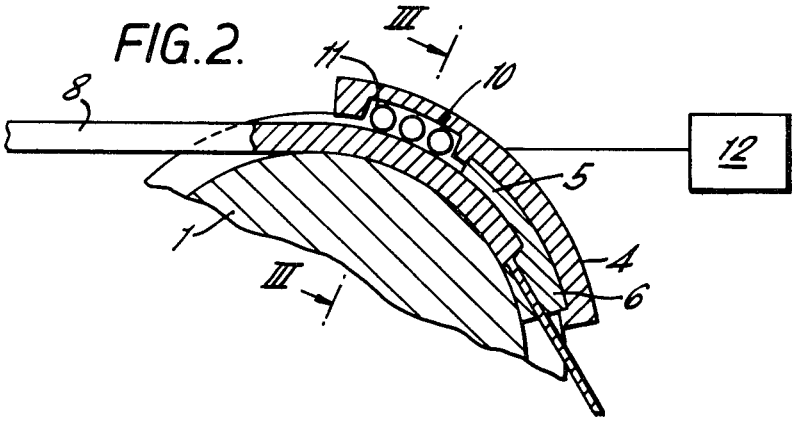
FIG.3.
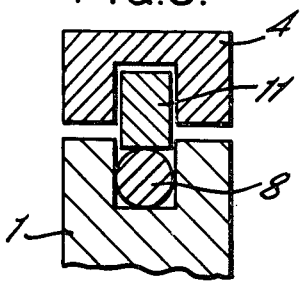

Pardoe et al.

[11] 4,106,320

[45] Aug. 15, 1978

[54] FORMING OF MATERIALS BY EXTRUSION

[75] Inventors: John Alan Pardoe, Lytham Saint Annes; Clifford Etherington, Blackpool; Eric Hunter, Preston, all of England

[73] Assignee: United Kingdom Atomic Energy Authority, London, England

[21] Appl. No.: 685,186

[22] Filed: May 11, 1976

Related U.S. Application Data

[63] Continuation of Ser. No. 570,782, Apr. 23, 1975, abandoned.

[30] Foreign Application Priority Data

May 7, 1974 [GB] United Kingdom ..... 20119/74
Dec. 11, 1974 [GB] United Kingdom ..... 53645/74

[51] Int. Cl.[2] ..... B21C 23/21; B21C 23/32
[52] U.S. Cl. ..... 72/256; 72/262; 72/56
[58] Field of Search ..... 72/253, 56, 262, 270, 72/256

[56] References Cited

U.S. PATENT DOCUMENTS

| | | | |
|---|---|---|---|
| 3,184,943 | 5/1965 | Ware | 72/206 |
| 3,657,910 | 4/1972 | Isobe et al. | 72/56 X |
| 3,765,216 | 10/1973 | Green | 72/262 |
| 3,798,942 | 3/1974 | Brackow | 72/253 |
| 3,872,703 | 3/1975 | Green | 72/262 |
| 3,874,207 | 4/1975 | Lemelson | 72/56 |
| 3,911,705 | 10/1975 | Voorhes | 72/270 |
| 3,922,898 | 12/1975 | Voorhes | 72/262 |
| 3,934,446 | 1/1976 | Avitzur | 72/262 |

*Primary Examiner*—Lowell A. Larson
*Assistant Examiner*—D. M. Gurley
*Attorney, Agent, or Firm*—Larson, Taylor and Hinds

[57] ABSTRACT

In the extrusion of a material, which can be a metal feedstock, through a die means by maintaining frictional engagement of the material with passageway defining surfaces of a member which is moved towards the die means such that frictional drag of the passageway defining surfaces urges the material through the die means, the improvement of enhancing the resultant available extrusion force by either increasing said frictional drag or reducing the frictional resistance to movement of said material relative to non-moving parts of said passageway, or a combination of both.

8 Claims, 6 Drawing Figures

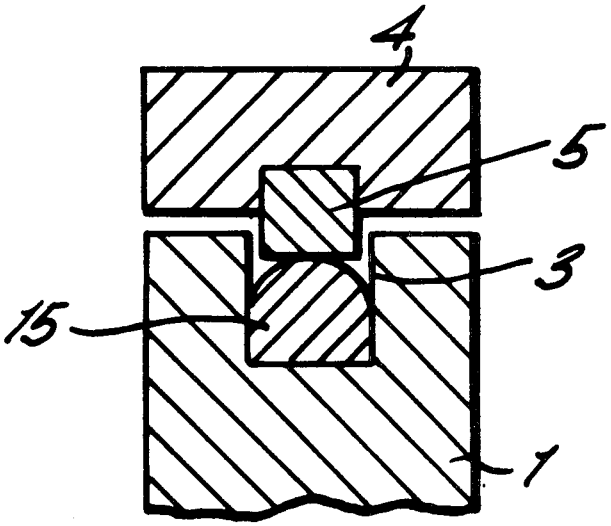

FORMING OF MATERIALS BY EXTRUSION

This is a continuation, of application Ser. No. 570,782 filed Apr. 23, 1975 now abandoned.

BACKGROUND OF THE INVENTION

The present invention relates to the forming of materials by extrusion.

In a known extrusion process the force of extrusion of a material, which material can be a metal feedstock, through a die means is derived by maintaining frictional engagement of the material with passageway defining surfaces of a member which is moved towards the die means such that frictional drag of the passageway defining surfaces urges the material through the die means.

Thus it is known to provide an extrusion apparatus having first and second members defining an elongate passageway therebetween, the first and second members being movable one relative to the other in the direction of the length of the passageway, an abutment member fixed relative to said second member to project into and block the passageway, means defining at least one die orifice leading from the passageway and associated with the abutment member, means for continuously feeding material into the passageway at a point spaced from the abutment member, the amount of surface area of the passageway defined by the first member which is movable towards the abutment member being greater than the amount of the surface area of the passageway defined by the second member whereby material fed into the passageway is moved by frictional drag with the surface of the passageway in the first member towards the abutment member and is thereby extruded through the die orifice or die orifices.

Conveniently the first member can be a wheel member having an endless groove therein with the second member covering a part of the length of the groove to form the passageway. The abutment member, which can be integral with the second member or formed as a separate component, projects into the groove to block one end of the passageway. The second member and the abutment member are held stationary and the wheel member is rotatable to drag material supplied to the end of the passageway remote from the abutment member along the groove towards the abutment member for extrusion through the die orifice or orifices.

The material fed into the passageway is carried towards the abutment member and extruded through the die orifice or orifices by the frictional drag produced at the surface area of the passageway defined by the movable member. The passageway can have a rectangular section with three walls thereof formed by the two side walls and the base of the groove in the movable member and the fourth wall being defined by the undersurface of the stationary member. The three walls in the movable member urge the material by frictional drag towards the abutment member while the material slides over the fourth wall formed by the undersurface of the stationary member. If the frictional coefficients are the same for all four walls and since the stationary surface is opposing the frictional drag applied to the material by the base of the groove in the movable member, in effect the material is carried towards the abutment member and extruded through the die orifice or orifices by the frictional drag of the two side walls in the movable member.

SUMMARY OF THE INVENTION

The present invention seeks to provide an extrusion process in which the force for extrusion of a material through a die means is derived by maintaining frictional engagement of the material with passageway defining surfaces of a member which is moved towards the die means such that frictional drag of the passageway defining surfaces urges the material through the die means, characterised in that the available extrusion force is enhanced by reducing the force opposing the extrusion force and generated by contact of the material with a non-moving part of the passageway defining surfaces, or by increasing the effective frictional drag on the material generated by the moving surfaces of the passageway defining surfaces, or by a combination of both such effects.

Thus also according to the present invention there is provided an extrusion apparatus having first and second members defining a passageway therebetween to receive material to be extruded, the first and second members being movable relative to one other in the direction of the length of the passageway, ie in the plane of the passageway, so that they co-operate to define said passageway, an abutment member fixed relative to one member to project into and block the passageway, and means defining at least one die orifice associated with the abutment member, and in which means are provided to enhance or improve the resultant available force acting to drag the material towards the abutment member through the die orifice or orifices, said means being effective to increase the difference in frictional effects at the passageway defining surfaces of the first and second members.

DESCRIPTION OF THE DRAWINGS

The invention will be described further, by way of example, with reference to the accompanying drawings; in which:

FIG. 1 is a diagrammatic, part sectional elevation of an extrusion apparatus;

FIG. 2 is a diagrammatic representation of a portion of the apparatus in FIG. 1 having means for reducing frictional forces opposing forward movement of a feedstock;

FIG. 3 is a section, not to scale, along line III—III in FIG. 2;

DESCRIPTION OF THE PREFERRED EMBODIMENTS

Figure 4:
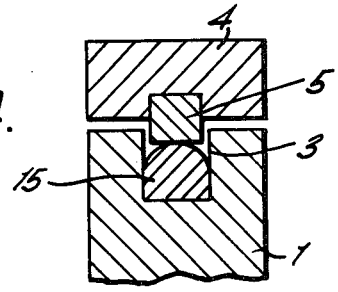
FIG. 4 is a section similar to that of FIG. 3 but showing a preformed feedstock.

FIG. 1 illustrates an extrusion apparatus comprising a wheel 1 rotatably mounted on a driven shaft 2 and having a rectangular cross-section continuous circumferential groove 3. A shoe member 4 fits against the edge of the wheel over a portion of its circumference. An insert member 5, which can be integral with or secured to the shoe member projects into the groove 3 and terminates in an abutment member 6 which blocks the passage formed between the wheel 1 and the shoe member 4. An extrusion orifice, or a plurality of such orifices, is or are associated with the abutment 6.

In FIG. 1 a single extrusion orifice 7 is formed in the abutment 6.

In operation a feedstock 8 is fed continuously into the groove 3 and the feedstock is carried forward in the groove beneath the shoe member and towards the abutment 6 upon rotation of the wheel 1. As a result the feedstock 8 is continuously extruded through the die orifice 7.

The groove 3 in the wheel 1 in conjunction with the shoe member 4 and the insert member 5 form a passageway to receive the feedstock. The walls of the passageway defined by the side walls and base of the groove move continuously toward the abutment. The wall of the passageway defined by the under-surface of the insert member is stationary. The moving walls, that is the walls of the passageway defined by the groove carry the feedstock by friction drug towards the abutment member and this movement is opposed by the friction at the stationary undersurface of the insert member.

FIGS. 2 and 3 illustrate one arrangement for reducing the friction at the under-surface of the stationary member. In this arrangement a roller assembly 10 is located at the undersurface of the shoe member 4 over an initial portion of its length. The roller assembly 10 can comprise a plurality of adjustable rollers 11.

Over this initial portion of its length the shoe member primarily serves to maintain the feedstock within the groove. As the feedstock moves towards the abutment member the pressure build-up is such as to cause the feedstock to be extruded through the die orifice 7 or orifices where provided. At the high pressure end of the passageway the feedstock will effectively fill the passageway and be in contact with the full surface areas of the fixed and movable members. However over the initial portion of the passageway this is not required and the frictional forces at the undersurface of the shoe member opposing forward travel of the feedstock are reduced by the roller assembly 10. It will be appreciated that other forms of surface which are capable of moving with the feedstock, such as a moving belt (not shown), can be located at the undersurface of the shoe member over the initial portion of the passageway.

Alternatively, or in addition, the frictional forces at the undersurface of the shoe member can be reduced by the application of ultrasonic vibration to the shoe member. In FIG. 2 the reference numeral 12 is employed to denote a source of ultrasonic vibration which can be applied to the shoe member.

The restraint to forward movement of the feedstock towards the abutment member can be diminished by reducing the area of the feedstock which comes into contact with the stationary undersurface of the shoe member at least over an initial portion of its travel through the passageway. The reduction in area can be achieved by utilising feedstock having a required preformed cross-section or by employing means capable of deforming feedstock to the required cross-section prior to its entry into the passageway.

FIG. 4 shows an example of preformed feedstock 15 introduced into the passageway. The feedstock is dimensioned to fit within the groove 3 in the wheel 1 so that the sides and base of the groove contact the corresponding sides or faces of the feedstock. However the upper side of the feedstock is formed with an arcuate surface so as to reduce to a minimum the contact area between this side and the undersurface of the insert member 5 over the initial portion of the passageway. Clearly other surface configurations are possible to achieve the same effect of reducing the restraint to forward movement of the feedstock.

Figure 5:
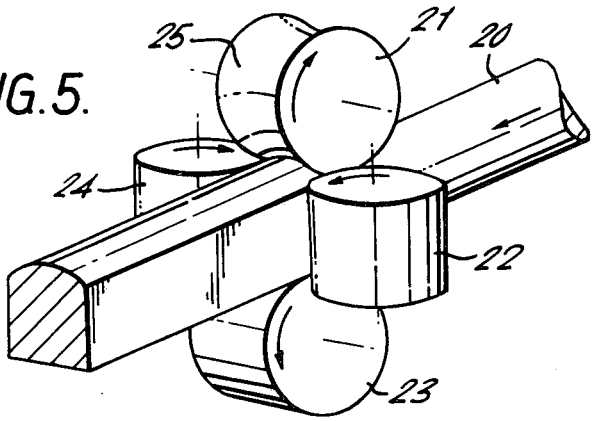
FIGS. 5 and 6 illustrate examples of forming rolls for shaping feedstock to a desired cross-section.

Normally feedstock will be of round (circular) or square (rectangular) cross-section. Such feedstock can be deformed to a desired cross-section, such as that shown in FIG. 4, by forming rolls arranged in the path of the feedstock prior to entry into the passageway between the wheel and the shoe member. One possible arrangement of forming rolls is shown in FIG. 5. In this arrangement feedstock 20 having a circular section is passed between four rollers 21, 22, 23 and 24. The rollers are rotatable in the directions of the arrows indicated thereon. The roller 21 is shaped with a concave circumferential groove 25 whereby to impart a convex profile to the uppersurface of the feedstock emerging from the roller assembly. The remaining rollers 22, 23 and 24 each impart a plane flat surface to the emerging feedstock. The rollers are positioned and arranged relative to one another whereby the emerging feedstock has the required shape and cross-section to fit the passageway in a manner as shown in FIG. 4. Clearly the arrangement and the number of rollers can be a matter of choice depending upon the shape to be imparted to the feedstock. Instead of employing forming rolls to preshape the feedstock, a draw die can be used for preshaping.

Instead of providing a separate arrangement of forming rolls as shown in FIG. 5 it is possible to preform the feedstock utilising the groove in the wheel and a co-operating grooved roller. The grooved wheel is equivalent to the assembly of rollers 22, 23 and 24 in FIG. 5 and a grooved roller, such as the roller 21 of FIG. 5, can be located to co-operate with the groove to deform the feedstock in a required manner. The roller 21 in this embodiment can be driven from the same power source so that employed for rotating the wheel 1 or can be driven from a separate power source. The roller 21 can be located immediately downstream of the entrance to the passageway between the wheel and the shoe member, or it can be located to be employed to itself define, with the groove in the wheel, the passageway or a part thereof.

Figure 6:
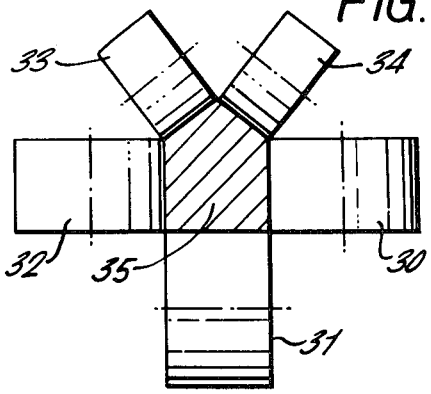

FIG. 6 illustrates an alternative arrangement of forming rollers. The rollers 30, 31, and 32 correspond to and function in the manner of the rollers 22, 23 and 24 in FIG. 5. Two inclined rollers 33 and 34 shape a feedstock 35 such that its upper surface upon emerging from the roller assembly has a triangular profile. This again reduces the amount of contact between the feedstock and the stationary member over an initial portion of the length of the passageway.

The friction at the undersurface of the stationary member can be reduced by introducing a lubricant between the undersurface and the contacting surface of the feedstock. The lubricant, which can be a vegetable or mineral oil eg molybdenum disulphide, a coating of a friction reducing material such as stellite, or even a flow of water, can be applied to the undersurface of the shoe member. The oil or water can also be applied to the surface of the feedstock. The underside of the shoe member can be highly polished, for the same purpose. With reference to FIG. 1, arrows X, Y and Z indicate three possible positions for the introduction of lubricant.

At position X, a lubricant is injected under pressure on to the upper surface of the feedstock at a region along the passage between the open end and the abutment. Conveniently the position X is approximately at the region where the feedstock commences to yield to completely fill the cross-section of the passageway.

Position Y is at the entrance to the passageway. The lubricant is applied to the top surface of the feedstock.

At position Z, lubricant is applied to the top surface of the feedstock prior to entry into the passageway.

The lubricant also serves to cool the parts to which it is applied.

In each and every case it is required that lubricant does not enter between the feedstock and the sides of the groove in the wheel as this would result in a decrease in frictional drag. Hence the upper surface of the feedstock to receive the lubricant must be such as to prevent the lubricant from flowing onto the other surfaces thereof in contact with the groove in the wheel. Thus the feedstock can be of square section or of any other section having a flat top surface. Alternatively the upper surface of the feedstock can be contoured so as to direct lubricant applied thereto away from the side edges thereof. For example the feedstock may be preformed with a shallow trough or a concave depression in its upper surface. In addition to serving as a means for receiving excess lubricant such a profiled upper surface would also result in a reduction in contact area with the surface of the stationary member.

For improving the forward drag applied to the feedstock, means may, in addition or alternatively to the friction-reducing expedients referred to hereinbefore, be provided for increasing the friction at the passageway surfaces of the moving member. For example, this can be achieved by roughening the side walls and base of the groove in the movable member. Such roughening can be achieved by forming a tread pattern on the side walls and base of the groove, or by knurling or grit blasting these surfaces. Yet again the frictional drag at the moving surfaces can be improved by coating these surfaces with a layer of the same material as the material to be extruded. For example, with a copper feedstock a coating of copper can advantageously be deposited on the passageway-defining surfaces in the movable member.

A further feature of the invention lies in controlling the operation of the extrusion process in dependence on a substantially continuous monitoring of at least one of the parameters characterising the product. The main factors relevant to process control are the driving speed and the supply, if this is used, of lubricant and/or cooling media. By way of example, the desired metallurgical quality for the product, possible as a preliminary for subsequent treatments, may entail compliance with certain temperature conditions and in this case the temperature of the product would be monitored continuously and would be applied automatically as a correcting or compensating feed back signal to one or more of the process controlling factors among which may be included the degree of preheat applied to the feed.

We claim:

1. In an extrusion process in which the force for extrusion of a material through a die means is derived by maintaining frictional engagement of the said material with passageway-defining surfaces of a member which is moved toward the die means, relative to a non-moving part of the passageway surface, such that frictional drag of the moving passageway-defining surfaces urges the said material through the die means, the improvement, for enhancing the force available for extrusion, wherein the cross-sectional configuration of said material in said passageway over an initial lengthwise portion thereof is such that over said initial lengthwise portion said material makes generally lengthwise line contact with said non-moving part and substantially greater than lengthwise line contact with one of the passageway-defining surfaces of said moving member.

2. A process as claimed in claim 1 wherein the cross-sectional configuration of said material in said passageway over an initial lengthwise portion thereof is such that over said initial lengthwise portion a substantial part of the cross-sectional surface of said material corresponds with and conforms to the cross-section of one of said surfaces of said moving member, but the cross-sectional surface of the material contacting said non-moving part does not materially correspond to or conform with the cross-sectional surface of said non-moving part.

3. In an extrusion process in which the force for extrusion of a material through a die means is derived by maintaining frictional engagement of the said material with passageway-defining surfaces of a member which is moved toward the die means, relative to a non-moving part of the passageway surface, such that frictional drag of the moving passageway-defining surfaces urges the said material through the die means, the improvement, for enhancing the force available for extrusion, wherein the cross-sectional configuration of said material at an initial lengthwise portion of said passageway is such that over said initial lengthwise portion said material contacts the surface of said non-moving part and said moving member, but contacts a relatively lesser proportion of the available surface area of said non-moving part and a relatively greater proportion of the available surface area of one of the passageway-defining surfaces of said moving member.

4. Apparatus as claimed in claim 3 wherein said initial lengthwise portion of the passageway has a base and side walls defined by wall portions of said moving member and a closure wall defined by said non-moving part, and wherein said cross-sectional configuration of said material is such that its surface portion facing said closure wall is convex relative to the closure wall, and at least one of the material surface portions is shaped similarly to its facing base or side wall of said passageway.

5. In an extrusion apparatus having first and second members defining a passageway therebetween for receiving material to be extruded, the first and second members comprising movable and non-movable members relative to one another in the plane of the passageway so that they cooperate, an abutment member fixed relative to one member to project into and block said passageway, die means associated with the abutment member, and means for moving said movable member to exert frictional drag of the movable passageway-defining surfaces on the material to be extruded, and thus generate extrusion force on the material, the improvement comprising means for enhancing the force available for extrusion, said means comprising forming rolls applied to the material for forming it into a shape such that the area of contact between the so-formed material and said non-movable member over said initial lengthwise portion of the passageway is reduced relative to the area of contact that would have been effected by the material in the shape it possessed before being formed into another shape by said forming rolls.

6. Apparatus as claimed in claim 5, wherein said forming rolls are disposed externally relative to said passageway and serve for preforming said material.

7. Apparatus as claimed in claim 5 wherein said initial lengthwise portion of the passageway has a cross-section having a base and side walls defined by wall portions of said movable member and a closure wall defined by said non-movable member, and said forming rolls are configured to form said material into a shape having at least its base and side walls conforming to the cross-sectional configuration of the corresponding base and side walls of said passageway more closely than the cross-sectional configuration of the other wall portion of said material conforms to said closure wall.

8. Apparatus as claimed in claim 7 wherein said closure wall is substantially planar as viewed in cross-section, and said other wall portion of said material is convex relative thereto.

* * * * *